US009265372B2

(12) United States Patent
Stewart-Stand

(10) Patent No.: US 9,265,372 B2
(45) Date of Patent: Feb. 23, 2016

(54) MULTIPURPOSE EATING UTENSIL

(71) Applicant: Theo Stewart-Stand, Brooklyn, NY (US)

(72) Inventor: Theo Stewart-Stand, Brooklyn, NY (US)

(73) Assignee: FOLDITFLAT, Brooklyn, NY (US)

( * ) Notice: Subject to any disclaimer, the term of this patent is extended or adjusted under 35 U.S.C. 154(b) by 170 days.

(21) Appl. No.: 14/220,154

(22) Filed: Mar. 20, 2014

(65) Prior Publication Data

US 2015/0182052 A1 Jul. 2, 2015

Related U.S. Application Data

(63) Continuation-in-part of application No. 14/140,586, filed on Dec. 26, 2013.

(51) Int. Cl.
*A47G 21/02* (2006.01)
*A47G 21/00* (2006.01)

(52) U.S. Cl.
CPC ..... *A47G 21/02* (2013.01); *A47G 2021/002* (2013.01)

(58) Field of Classification Search
CPC ..... A47G 21/02; A47G 2021/002
See application file for complete search history.

(56) References Cited

U.S. PATENT DOCUMENTS 636,735 A * 11/1899 Davenport ..... A47F 13/08 297/180
972,777 A * 10/1910 Richardson ..... A47G 21/06 30/147
1,372,325 A * 3/1921 Willemin ..... A47G 21/06 30/143
1,406,492 A * 2/1922 Robinson ..... A61C 9/0006 433/45
1,521,768 A * 1/1925 Herrmann ..... A47G 21/04 30/328
1,607,863 A * 11/1926 Betts ..... A47G 19/06 206/229
1,851,942 A * 3/1932 Christie ..... A47G 21/04 30/328
2,311,107 A * 2/1943 De Fraties ..... A47G 21/06 30/143
2,318,129 A * 5/1943 Torode ..... A47G 21/06 30/147
2,453,393 A * 11/1948 Wilson ..... A47G 21/04 215/228
2,456,858 A * 12/1948 Bolling ..... A47G 21/06 24/697.1
2,473,288 A * 6/1949 McNeill ..... A47G 21/02 30/147
2,728,516 A * 12/1955 Rodman ..... A47G 23/0216 206/216
3,121,951 A * 2/1964 Green ..... A47G 21/02 30/149
3,828,999 A * 8/1974 Humphrey ..... A47G 21/04 229/401
3,931,925 A * 1/1976 Ruff ..... A47G 21/04 229/125.03
4,218,010 A * 8/1980 Ruff ..... A47G 21/04 229/125.03

(Continued)

*Primary Examiner* — Sean Michalski
(74) *Attorney, Agent, or Firm* — Andrew Wilford

(57) ABSTRACT

A multipurpose eating utensil has a pair of side parts of thin but flexible sheet material having confronting adjacent edges interconnected by a unitary membrane hinge for movement of the side parts to move between a flattened position extending generally coplanar with each other and a folded use position extending at an acute angle or even parallel to each other from the hinge. A front utensil part is formed unitarily with the side parts and has an inner edge joined unitarily to ends of both of the side parts, an outer edge formed with a plurality of longitudinally projecting fork tines, and a longitudinally extending side edge formed as a cutting tool. A rear utensil part is formed unitarily with the side parts. A fastener on at least one of the side parts secures the side parts together in the folded use position.

7 Claims, 3 Drawing Sheets

(56) References Cited

U.S. PATENT DOCUMENTS 4,535,538 A * 8/1985 Nelson ..... A47G 21/02 30/147
4,539,749 A * 9/1985 Hyeong-Woon ..... A47G 21/06 30/147
4,589,204 A * 5/1986 Vogel ..... A47G 21/02 16/429
4,940,189 A * 7/1990 Cremonese ..... B65D 5/008 141/337
5,197,623 A * 3/1993 Wang ..... B65D 51/246 206/542
5,327,650 A * 7/1994 Rojas ..... A47G 21/06 30/147
5,845,403 A * 12/1998 Nivin ..... A47G 21/06 30/147
6,067,717 A * 5/2000 Perlman ..... A47G 21/02 30/142
D434,982 S * 12/2000 Zimmerman ..... A47G 21/02 206/553
D439,163 S * 3/2001 Zimmerman ..... A47G 21/02 D9/433
6,896,515 B2 * 5/2005 Cozzi ..... A61C 9/0006 433/37
D571,162 S * 6/2008 Fite, IV ..... A47G 21/02 D7/642
7,798,327 B1 * 9/2010 Berkani ..... A61F 13/55145 206/440
D646,529 S * 10/2011 Cross ..... A47G 21/02 D7/642
D651,480 S * 1/2012 Cross ..... A47G 21/02 D7/642
8,210,381 B2 * 7/2012 Cross ..... A47G 21/04 215/228
9,131,793 B2 * 9/2015 Cross ..... A47G 21/04
2006/0218795 A1 * 10/2006 Santa Cruz ..... A47G 19/06 30/147
2007/0017964 A1 * 1/2007 Kamolsuwan ..... B65D 5/2047 229/155
2007/0084064 A1 * 4/2007 Fite ..... A47G 19/02 30/324
2007/0101578 A1 * 5/2007 Shirazi ..... A47G 21/06 30/147
2008/0148575 A1 * 6/2008 Chan ..... A47G 21/02 30/150
2010/0218382 A1 * 9/2010 Scott ..... B67B 7/18 30/147
2012/0110746 A1 * 5/2012 Allard Serrano ..... A47G 21/06 7/151
2014/0190022 A1 * 7/2014 Siren ..... A47J 43/281 30/324
2014/0259685 A1 * 9/2014 Cross ..... A47G 21/06 30/150
2015/0175292 A1 * 6/2015 McCullough ..... B65D 5/22 426/128
2015/0257560 A1 * 9/2015 Boateng, II ..... A47G 21/001 30/136
2015/0257561 A1 * 9/2015 Miksovsky ..... A47G 21/06 30/150

* cited by examiner

Fig.3
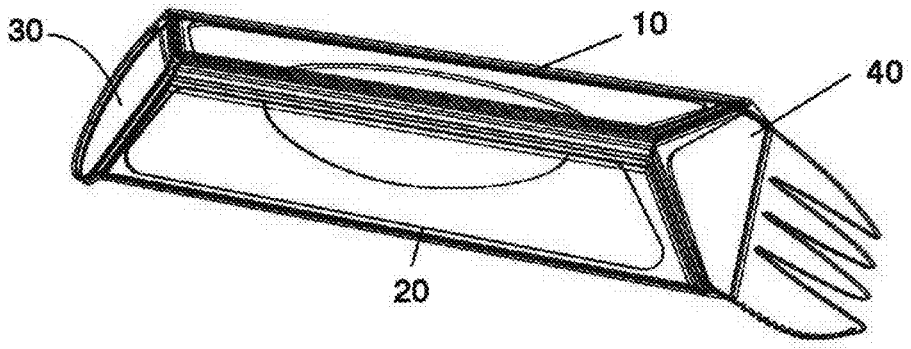
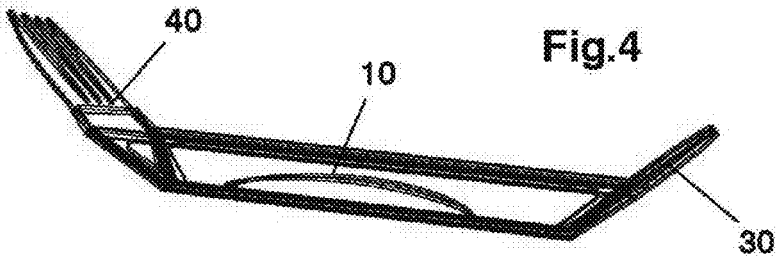
Fig.4
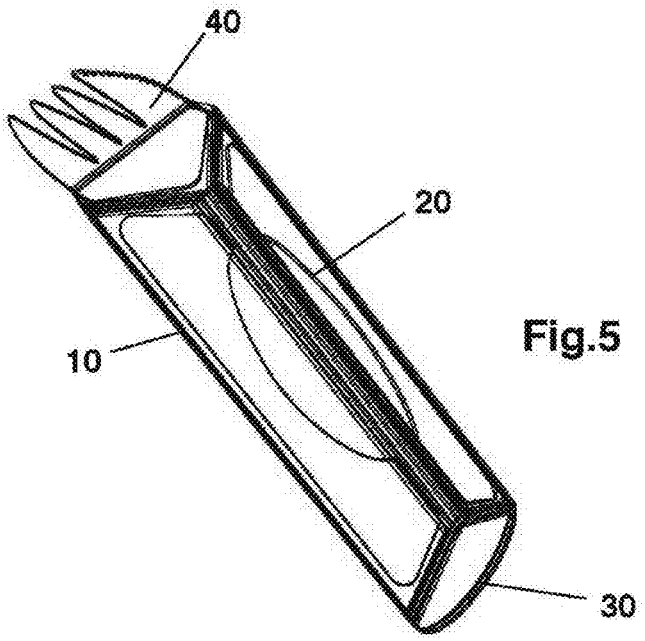
Fig.5

MULTIPURPOSE EATING UTENSIL

CROSS-REFERENCE TO RELATED APPLICATION

This application is a continuation-in-part of copending application Ser. No. 14/140,586 filed 26 Dec. 2013.

FIELD OF THE INVENTION

The present invention relates to a multipurpose eating utensil. More particularly this invention concerns such a utensil that can be used as at least as a spoon or fork, but also as a knife, and that can be carried or stored flat.

BACKGROUND OF THE INVENTION

It is known to make a so-called spork of a single piece of plastic, with one end formed as a standard flat eating-utensil handle, and the other end formed with a slightly cup-shaped bowl for use as a spoon and an outer edge provided with teeth for use as a fork. Such a utensil is typically provided to small children who are not capable of switching between utensils, and who might harm themselves with standard forks, not to mention the harm that could be done even with a plastic knife.

It is also known to provide a pen knife with spoon, fork, and of course knife attachments so that it can be used, for instance, by a camper who need not carry a selection of utensils for eating when away from civilization.

None of these applications is fully satisfactory. The child's spork is useless when food has to be cut or, for instance, it is necessary to spread something like butter. The camper's device requires manipulation for switching from one use to the other. Both systems do not store flat, that is they cannot be reduced to a shape that is efficient for storage and transport.

OBJECTS OF THE INVENTION

It is therefore an object of the present invention to provide an improved multipurpose eating utensil.

Another object is the provision of such an improved multipurpose eating utensil that overcomes the above-given disadvantages, in particular that can be used as both a spoon and a fork and, if desired, a knife also.

A further object is to provide such a utensil that can be used without manipulation for any of its two or three applications.

Another object is to provide such a utensil that can be stored perfectly flat, that is lying in a plane so that it takes up very little space and can be stacked.

SUMMARY OF THE INVENTION

A multipurpose eating utensil has according to the invention a pair of geometrically similar side parts of thin but flexible sheet material having confronting adjacent edges interconnected by a unitary membrane hinge for movement of the side parts to move between a flattened position extending generally coplanar with each other and a folded use position extending at an acute angle or even parallel to each other from the hinge. A front utensil part is formed unitarily with the side parts of the thin but flexible sheet material and has an inner edge joined unitarily to ends of both of the side parts, an outer edge formed with a plurality of longitudinally projecting fork tines, and a longitudinally extending side edge formed as a cutting tool. A rear utensil part is formed unitarily with the side parts of the thin but flexible sheet material so that in the folded use position the rear utensil part forms a spoon bowl. A fastener on at least one of the side parts secures the side parts together in the folded use position.

Such a utensil can be made at very low cost so as to be reusable. On the other hand, it works well as a spoon, knife, and fork so that it is perfect for use, for instance at a picnic, when regular utensils would be an encumbrance.

The sheet material according to the invention is plastic. Polypropylene or any durable resin is usable. The basic body can be formed by injection molding or stamping.

The fastener has a part on each of the side parts. It can be a simple snap fastener, a hook-and-barb fastener, or a sticky adhesive spot.

BRIEF DESCRIPTION OF THE DRAWING

The above and other objects, features, and advantages will become more readily apparent from the following description, reference being made to the accompanying drawing in which:

FIG. 3 is a perspective back view of the FIG. 1 utensil when in the use position;

FIG. 4 is a perspective side view of the FIG. 1 utensil in the use position;

FIG. 5 is another perspective back view of the FIG. 1 utensil in the use position;

SPECIFIC DESCRIPTION OF THE INVENTION

Figure 1:
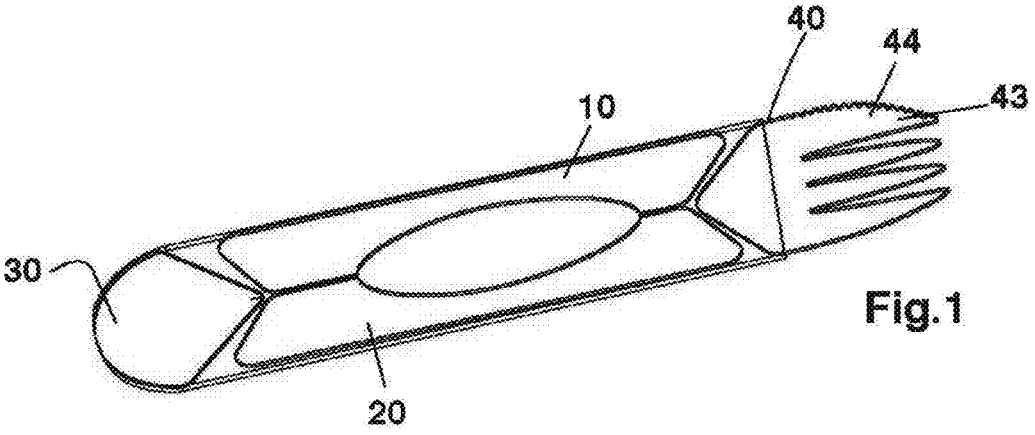
FIG. 1 is a perspective front view of a first embodiment of the utensil according to the invention in flattened transport/storage position, it being noted that the perspective back view from the opposite direction is identical.
Figure 2:
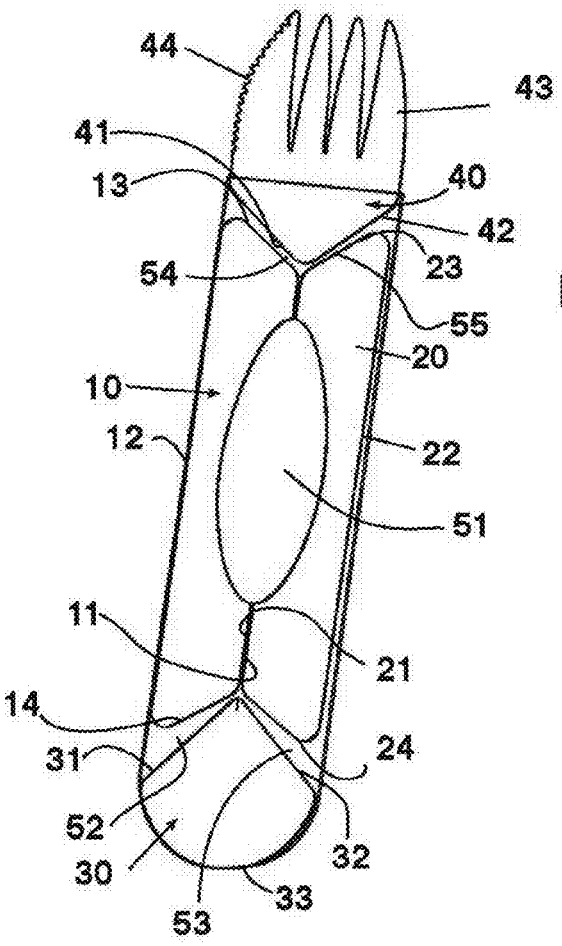
FIG. 2 is a plan view of the FIG. 1 flattened utensil.

As seen in FIGS. 1 and 2, the utensil according to the invention shown here in flattened condition is formed basically of two side parts 10 and 20 and two end parts 30 and 40 each stamped out of a flexible but stiff stainless-steel sheet.

The two side parts 10 and 20 are identical isosceles trapezoids with their shorter minor base edges 11 and 21 parallel, longitudinal, and closely juxtaposed, their major base edges 12 and 22 also longitudinal and parallel but turned away from each other, their side edges 13 and 23 extending at 45° to the longitudinal extent and forming a longitudinally open V-shape, and their side edges 14 and 24 similarly extending at 45° to the longitudinal and forming a longitudinally oppositely open V-shape. The edges 11-14 and 21-24 are all straight and meet at slightly rounded corners.

The one end part 30 has straight inner edges 31 and 32 extending at 90° to each other and closely juxtaposed with and parallel to the respective edges 14 and 24 and a circularly arcuate outer edge 33 connecting ends of the edges 31 and 32. This part 30 forms the spoon of the invention as described below.

The other end part 40 has straight inner edges 41 and 42 extending like the edges 31 and 32 parallel to the respective edges 13 and 23 and an opposite edge formed with four longitudinally projecting triangular tines 43, of which an outer one is formed along its generally longitudinally extending edge with teeth 44. The tines 43 form the fork and the teeth 44 the knife of the invention as described below.

The edges 11 and 21 are connected together by a hinge 51, the edges 14 and 21 by a hinge 52, the edges 24 and 32 by a hinge 53, the edges 13 and 41 by a hinge 54, and the edges 23 and 42 by a hinge 55. This hinge can be made of silicone molded over the parts 10, 20, 30 and 40, could be integral with the parts 10, 20, 30, and 40 if they were all made for instance of plastic as in the embodiment of FIGS. 6-8, or could be purely mechanical hinges with knuckles and pintles.

The instant invention thus typically can lie completely flat, that is with all the parts 10, 20, 30, and 40 coplanar. This makes it easy to carry in a pocket or backpack, and makes it possible to even carry a large number of them in a very small space. While flat the utensil can be stacked, and can even be curved somewhat without permanent damage.

For use all that is necessary as shown in FIGS. 3 and 4 is to press together the outer edges 12 and 22 of the side parts 10 and 20 so that they lie at a large obtuse angle to each other. This causes both the end parts 30 and 40 to pivot upward to a positions with their outer ends raised. In this position the fork tines 43 extend at an angle to the central "handle" formed by the parts 10 and 20, and the raised part 30 forms a concavity usable as the bowl of a spoon centered on a point where the ends 14, 24, 31, and 32 meet. Thus the end of the multipurpose utensil formed by the part 40 is a fork and the end formed by the part 30 is a spoon. In reality the outer edges 12 and 22 of the parts 10 and 20 are, contrary to what is shown in FIGS. 3-5, curved in the use position. That is during use both outer edges 12 and 22 would be arcuately concave away from each other.

The toothed edge 44 can be used as a knife in both the flattened (FIGS. 1 & 2) and use (FIGS. 3-5) positions of the utensil.

Figure 6:
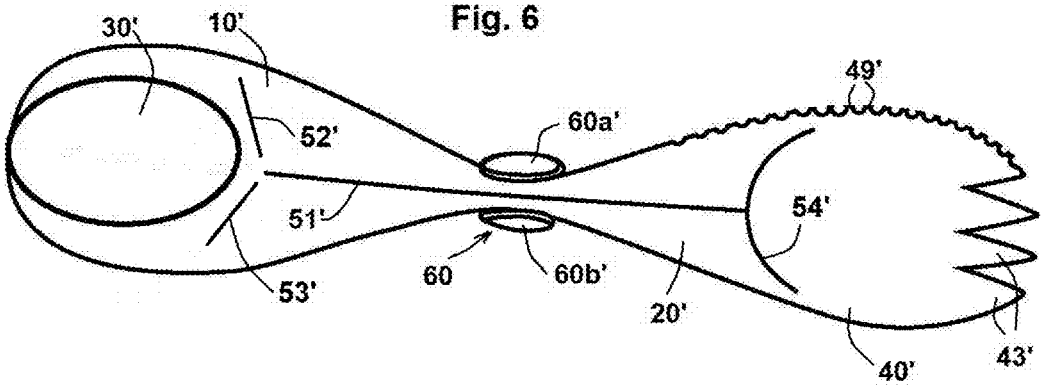
FIG. 6 is a bottom view of another embodiment of the utensil according to the invention in the use position.
Figure 7:
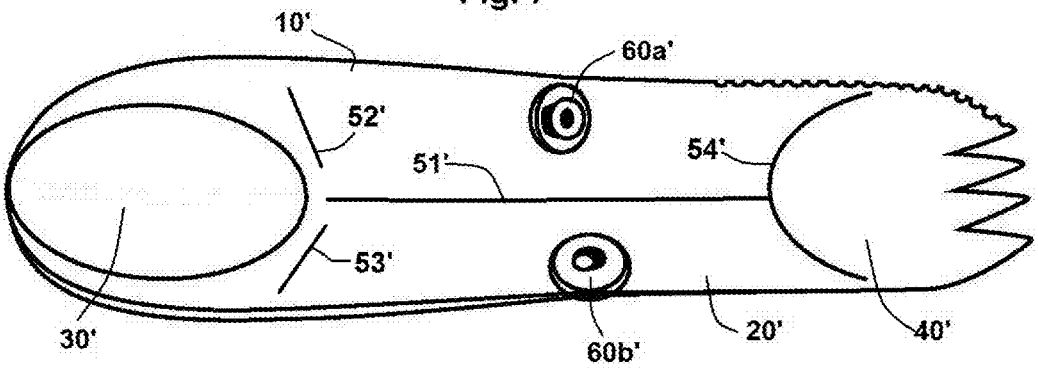
FIG. 7 is a top view of the FIG. 6 utensil in the flattened position.
Figure 8:
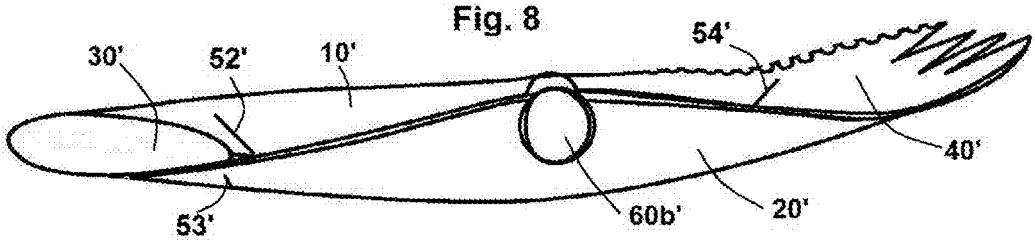
FIG. 8 is a side perspective view of the FIG. 6 utensil in the use position.

FIGS. 6-8 show a multipurpose utensil made basically of a single piece of flexible and elastically deformable but stiff plastic, here polypropylene, plus a fastener 60 formed by two parts 60*a* and 60*b*. Two side parts 10' and 20' are joined together at a straight central unitary membrane hinge 51' rearward of a front-end fork/knife part 40' having teeth 43' and forward of a rear-end spoon part 30'. The parts 10' and 20' respectively carry the snap parts 60*a* and 60*b* generally centrally toward their outer edges.

Here the fastener parts 60*a* and 60*b* are parts of a snap fastener, but they could be simple reusable or single-use adhesive spots, mating barb/loop patches, magnets, or some fastener adapted to hold the two side parts 10' and 20' together as shown in FIGS. 6 and 8.

The fork part 40' has one edge formed with teeth 49' to serve as a knife and is otherwise smooth and uninterrupted so that, when the side parts 10' and 20' are snapped together, the part 40' deforms into a shallow cup shape so as to be quite rigid. An arcuate fold line 54' concave toward the teeth 43' separates the rear end of the fork part 40' from the front ends of the side parts 10' and 20' and ensures that the fork part 40' cups somewhat in the folded use position of FIG. 8.

The spoon part 30' is formed with a central oval zone serving to identify it as a spoon and not folding significantly when the sides 10' and 20' are snapped together. It is separated from the rear ends of the side parts 10' and 20' by fold lines 52' and 53' that are straight and extend at an obtuse angle to each other and to the center fold line 51'

I claim:

1. A multipurpose eating utensil comprising:

a pair of geometrically similar side parts of thin but flexible sheet material having confronting adjacent edges interconnected by a unitary membrane hinge allowing the side parts to move between a flattened position extending generally coplanar with each other and a folded use position extending at an acute angle to each other from the hinge;

a front utensil part formed unitarily with the side parts of the thin but flexible sheet material and having an inner edge joined unitarily to ends of both of the side parts, an outer edge formed with a plurality of longitudinally projecting fork tines, and a longitudinally extending side edge formed as a cutting tool;

a rear utensil part formed unitarily with the side parts of the thin but flexible sheet material, whereby in the folded use position the rear utensil part forms a spoon bowl; and a fastener on at least one of the side parts for releasably securing the side parts together in the folded use position.

2. The eating utensil defined in claim 1, wherein the sheet material is plastic.

3. The eating utensil defined in claim 1, wherein the fastener has a part on each of the side parts.

4. The eating utensil defined in claim 3, wherein the fastener parts snap together.

5. The eating utensil defined in claim 1, further comprising:

a fold line in the sheet material between the front fork part and the front ends of the side parts.

6. The eating utensil defined in claim 1, further comprising:

at least one transverse fold line between the spoon part and the rear ends of the side parts.

7. The eating utensil defined in claim 6 wherein there are two such transverse fold lines, each between a respective one of the rear ends of the side parts and the spoon part.

* * * * *